United States Patent [19]

Sando et al.

[11] 4,405,491

[45] Sep. 20, 1983

[54] APPARATUS FOR FORMING FOAM

[75] Inventors: Yoshikazu Sando; Hiroshi Ishidoshiro, both of Wakayama, Japan

[73] Assignee: Sando Iron Works Co., Ltd., Tokyo, Japan

[21] Appl. No.: 306,768

[22] Filed: Sep. 29, 1981

[30] Foreign Application Priority Data

Oct. 2, 1980 [JP] Japan ..... 55-140970[U]
Oct. 17, 1980 [JP] Japan ..... 55-148148[U]

[51] Int. Cl.[3] ..... B01F 3/04; B01F 7/12

[52] U.S. Cl. ..... 252/359 E; 261/DIG. 26; 366/604

[58] Field of Search ..... 252/359 E; 261/DIG. 26; 46/8; 366/604, 305, 318, 320

[56] References Cited

U.S. PATENT DOCUMENTS 2,495,441 1/1950 Campbell ..... 252/359 E
3,119,779 1/1964 Barrows et al. ..... 252/359 E
3,215,642 11/1965 Levy ..... 252/359 E
3,355,151 11/1967 Menzel ..... 252/359 E
3,523,908 8/1970 Levy ..... 252/359 E
3,814,697 6/1974 Hashimoto ..... 252/359 E

*Primary Examiner*—Bradley Garris
*Attorney, Agent, or Firm*—Toren, McGeady and Stanger

[57] ABSTRACT

An apparatus for forming foam including a rotatable screw shaft having concave grooves or convex stripes extending spirally along its outer circumference and located in a cylinder closely spaced from one another for passing a treating solution containing a foaming agent, such as soap, together with pressurized air through the gap between the screw shaft and the cylinder. It is preferable to provide a plurality of square grooves along the inner circumference of the cylinder extending spirally or in the axial direction of the cylinder. Foam of the treating solution can be continuously produced in an effective manner, and the apparatus is particularly suitable for continuously applying a treating solution to a cloth.

1 Claim, 5 Drawing Figures

APPARATUS FOR FORMING FOAM

BACKGROUND OF THE INVENTION

The present invention relates to an apparatus for forming foam for the purpose, for instance, of applying a treating solution to a cloth continuously in the form of foam.

In applying a treating solution such as a pretreating solution and a dye solution continuously to a cloth produced commercially, the cloth has conventionally been immersed continuously in a liquid tank containing the treating solution. However, in such a treating solution applying means, it is difficult to maintain constant the concentration of the treating solution to be applied and to apply a limited amount of the treating solution to completely cover the cloth uniformly. Accordingly, such troubles occur that a large amount of water is consumed and a specified squeeze roll is needed.

Thereupon, the present inventors have proposed a convenient method for continuously applying a treating solution to a cloth in which the treating solution is applied to the cloth in the form of a foam. A prescribed amount of the treating solution can be applied uniformly to completely cover the cloth, so that such drawbacks as the consumption of water and the use of a squeeze roll can be eliminated.

However, a satisfactory apparatus for forming foam has not yet been disclosed. An apparatus is required for forming foam for continuously applying a treating solution in the form of foam such that a large amount of foam can be continuously produced, the size of the foam can easily be controlled to meet with the requirement, and the construction of the apparatus is simple.

SUMMARY OF THE INVENTION

Under such circumstances, the object of the present invention is to offer a unique apparatus, particularly, for forming foam for use in continuously applying a treating solution to a cloth in the form of foam by satisfying all the requisites as above mentioned.

The principle of the present inventive apparatus comprises providing a rotatable screw shaft having convex stripes or concave grooves extending spirally along its outer circumference within a cylinder for passing a treating solution containing a foaming agent such as soap together with pressurized air through the gap between the screw shaft and the cylinder. The convex stripes or concave grooves extend almost perpendicularly to the axis of the screw shaft.

DETAILED DESCRIPTION OF THE PREFERRED EMBODIMENTS

Figure 1:
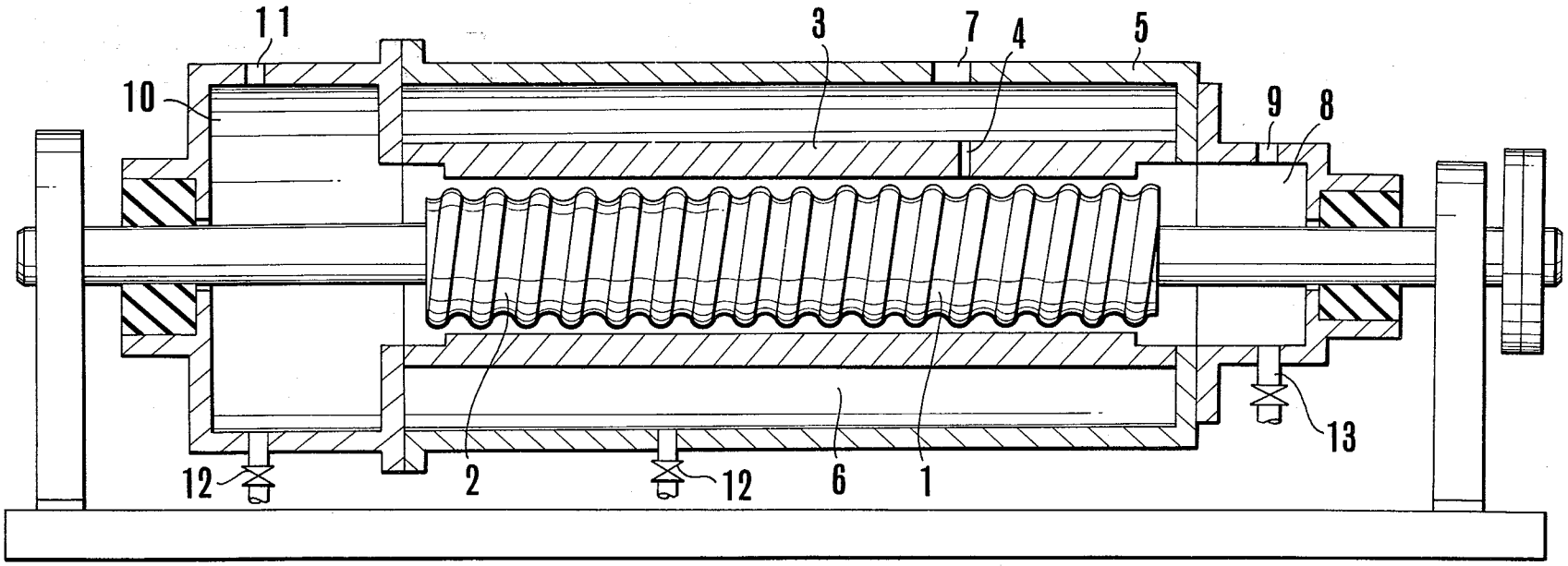
FIG. 1 is a sectional side view of an example of the present inventive apparatus for forming foam.

Preferred embodiments of the present inventive apparatus for forming foam will be described in detail in the following with reference to the examples of the apparatus shown in the drawings.

EXAMPLE 1

In FIG. 1, a screw shaft 1 is driven by a motor, not shown. The screw shaft 1 is provided with concave grooves 2 extending spirally along its outer circumference. The concave grooves extend almost perpendicularly to the axis of the screw shaft. A hollow cylinder 3 is provided outside of the screw shaft 1, close to the outer circumference of the screw shaft. The screw shaft 1 is maintained freely rotatable in the cylinder. A plurality of air supply holes 4 are provided at a position near one end of the cylinder 3 and extend through the cylinder. A cylindrical outer frame 5 is provided outside of the cylinder 3, forming an air-tight pressurized air chamber 6 therebetween. An air supply opening 7 is provided through the cylindrical outer frame 5 for supplying pressurized air into the pressurized air chamber 6. A liquid chamber 8 is provided at one end of the cylinder 3, and a treating solution supply opening 19 communicates with the liquid chamber 8. At the other end of the cylinder 3, a foam chamber 10 is provided, and a foam outlet 11 opens from the foam chamber 10. Drain outlets 12 are provided for discharging material accumulated in the pressurized air chamber 6 and in the foam chamber 10, and a waste solution discharge outlet 13 is provided from the liquid chamber 8.

The function of this apparatus will now be described in the following. In the first place, air at a prescribed pressure coming from a pressure control valve (not shown in the figure) is supplied through the air supply opening 7 into the pressurized air chamber 6, and a prescribed treating solution containing a foaming agent, whose amount is controlled by means of a flow meter (not shown in the figure), is supplied into the liquid chamber 8. Then, the screw shaft 1 is rotated by driving it with a motor at a speed of, for instance, from 1800 to 4500 rpm and pressurized air is supplied from the pressurized air chamber 6 through the air supply holes 4 into the interior of the cylinder 3 for transporting the treating solution in the liquid chamber 8 toward the foam chamber 10 at a constant rate. Pressurized air and the treating solution are mixed to form foam due to the rotation of the screw shaft 1, and the foam produced is forwarded into the foam chamber 10. The foam of the treating solution thus produced exits through the foam outlet 11 for the use of, for instance, continuously applying the foam to a cloth.

The present inventive apparatus for forming foam has various merits such as in the following. Since a given amount of the treating solution is mixed with a given amount of air under a constant pressure by rotating the screw shaft, foam of a constant quality can be continuously produced, and this is particularly suitable for continuously applying a treating solution in the form of a foam to a cloth. By controlling the rotational speed of the screw shaft, the amount of the foam produced and the size of the foam can freely be controlled. Further, by controlling the mixing ratio of the treating solution and pressurized air, the foaming rate can also be controlled. The present inventive apparatus for forming foam is simple in its construction, causes no trouble in operation and can produce a large amount of foam, so that the apparatus is quite beneficial particularly for continuously applying a treating solution to a cloth.

EXAMPLE 2

Figure 2:
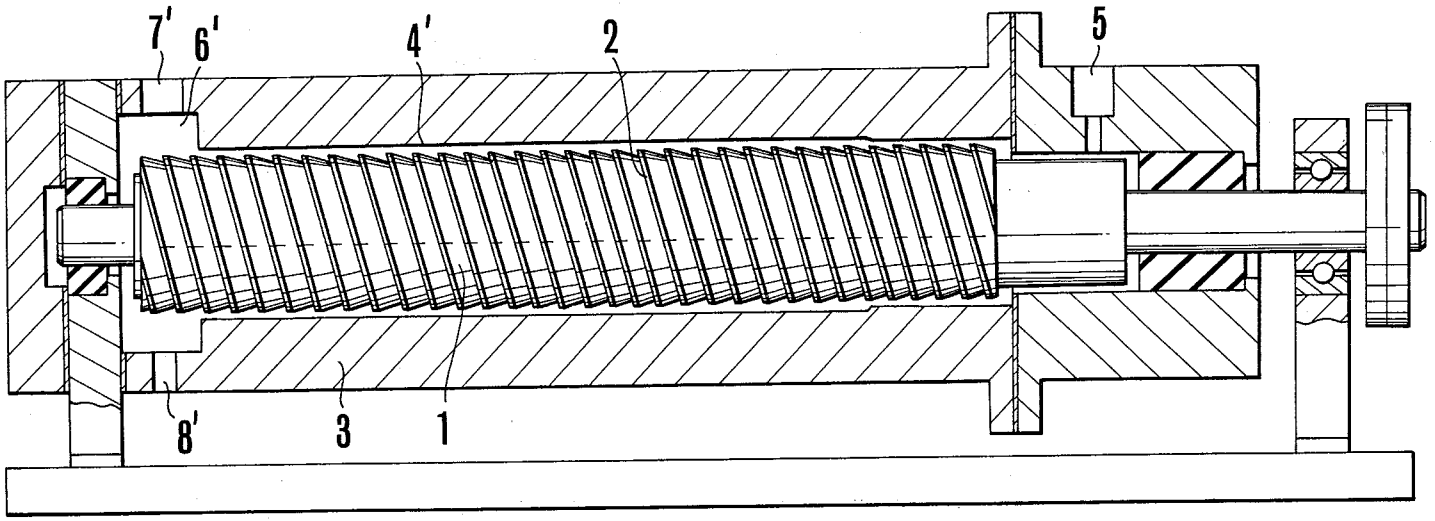
FIG. 2 is the same in Example 2.
Figure 3:
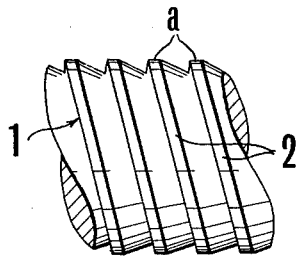
FIG. 3 is a partial enlarged diagram of the screw shaft in FIG. 2.
Figure 4:
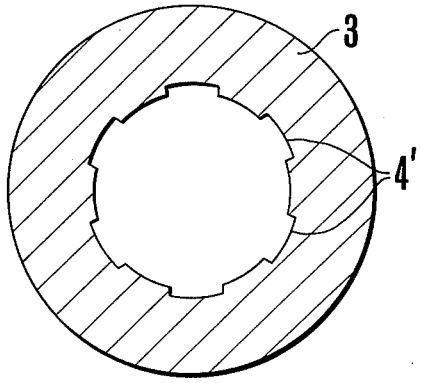
FIG. 4 is a sectional diagram of the cylinder in FIG. 2.

As shown in FIG. 2, the screw shaft in this example is provided with convex stripes 2 extending spirally along its outer circumference instead of using concave grooves as in Example 1. The convex strips extend almost perpendicularly to the axis of the screw shaft. As shown in FIG. 3, in the sectional shape of the convex stripes 2, each stripe has a relatively short axially extending frusto-conical section extending inwardly from the top of the adjacent stripe followed by a longer axially extending frusto-conical section extending outwardly to the generally cylindrically shaped top a, the tops thereof are formed flat and these flat portions are close to the inner circumference of the cylinder 3. A plurality of square grooves 4' are provided in the inner circumference of the cylinder 3 and extend in its axial direction, as shown in FIG. 4. The square grooves 4' may extend spirally. A fluid supply opening 5' is provided near one end of the cylinder 3 for supplying a treating solution containing a foaming agent together with pressurized air into the gap between the screw shaft 1 and the cylinder 3, and a foam tank 6' is provided at the other end of the cylinder 3. A foam outlet 7' is provided from the upper end of the foam tank 6', and a drain outlet 8' is provided from the bottom of the foam tank 6'. Other constructions of this example will be understood from Example 1 shown in FIG. 1. In forming foam by using this apparatus, air at a prescribed pressure coming from a pressure control valve (not shown in the figure) and a prescribed treating solution, whose amount is controlled by means of a flow meter (not shown in the figure), are supplied through the fluid supply opening 5' into the gap between the screw shaft 2 and the cylinder 3. Then, the screw shaft 1 is rotated by driving a motor. A mixture of the treating solution and air supplied from the fluid supply opening 5' is transferred over the shaft 1 to the foam tank 6' while forming foam due to the mixing action caused by the rotation of the screw shaft 1, and the foam of the treating solution thus produced exists through the foam outlet 7' for the use of, for instance, applying the foams to a cloth continuously.

The most distinguished feature of the apparatus in this example is to provide a flat portion a on the convex stripes 2 of the screw shaft and square grooves 4 along the inner circumference of the cylinder 3. In rotating the screw shaft, there occurs a cutting effect between the treating solution and air due to the combined action of the edges of the flat portion a of the screw shaft 1 and the edges of the square grooves 4, and, accordingly, a very fine creamy foam with a high viscosity can be produced. Such fine foams are quite excellent for continuously applying a treating solution to a cloth in the form of foam.

EXAMPLE 3

Figure 5:
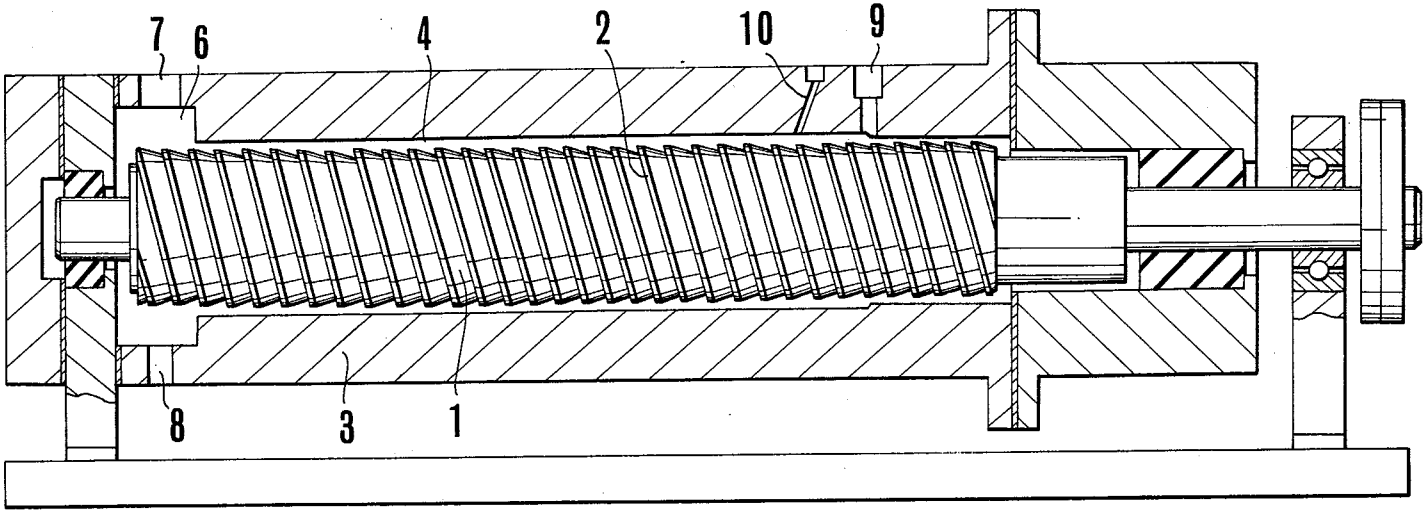
FIG. 5 is a sectional side view of the present inventive apparatus in Example 3.

Example 3 shown in FIG. 5 differs from the apparatus shown in FIG. 2 only in that a liquid supply opening 9 for supplying a treating solution containing a foaming agent and an air supply opening 10 are provided separately instead of the fluid supply opening 5' in FIG. 2. The function and effect of the two apparatuses are the same.

What is claimed is:

1. An apparatus for forming foam for use in continuously applying a treating solution to a cloth, comprising an axially elongated hollow cylinder having a circular interior surface, an axially extending rotatable screw shaft located within said cylinder with the outer surface of said shaft spaced closely from the interior surface of said cylinder, said shaft having spirally extending convex stripes on the outer surface thereof with the radially outer surfaces of said stripes spaced closely inwardly from the radially inner surface of said hollow cylinder, and said cylinder having axially extending grooves formed in and extending radially outwardly from the inner surface thereof, and means for passing a treating solution including a foaming agent such as soap together with pressurized air through the space between the outer surface of the screw shaft and the inner surface of the cylinder, said grooves formed in the inner surface of said cylinder are rectangularly shaped in cross-section extending transversely of the axial direction of said cylinder and said grooves are spaced angularly apart around the inner surface of said cylinder, said convex stripes extend almost perpendicularly to the axis of said cylinder and include a relatively short axially extending frusto-conical first section extending inwardly from the end of one stripe followed by a longer axially extending frusto-conical second section extending generally outwardly to the radial outer surface of an adjacent stripe with a generally cylindrically shaped axially extending top located in the radially outer surface of said screw shaft and abutting said first section of the following stripe, the axis of said cylinder is horizontally arranged, said means comprises a fluid supply opening through said cylinder adjacent one end of said screw shaft for supplying a treating solution containing a foaming agent along with pressurized air into the space between said screw shaft and said cylinder, said cylinder forming a foam tank at the other end of said screw shaft, a foam outlet extending through said cylinder from said foam tank with said foam outlet located in the upper part of said foam tank, and a drain outlet through said cylinder from the bottom of said foam tank.

* * * * *